US007234403B2

(12) United States Patent
Fluckiger et al.

(10) Patent No.: US 7,234,403 B2
(45) Date of Patent: Jun. 26, 2007

(54) SEWING OR EMBROIDERY MACHINE

(75) Inventors: Hans Fluckiger, Oetwil am See (CH); Heinz Janouschek, Steckborn (CH)

(73) Assignee: Fritz Gegauf Aktiengesellschaft Bernina-Nahmaschinen Fabrik, Steckborn (CH)

( * ) Notice: Subject to any disclaimer, the term of this patent is extended or adjusted under 35 U.S.C. 154(b) by 0 days.

(21) Appl. No.: 10/552,123

(22) PCT Filed: Mar. 19, 2003

(86) PCT No.: PCT/CH04/00168

§ 371 (c)(1),
(2), (4) Date: Oct. 5, 2005

(87) PCT Pub. No.: WO2004/090216

PCT Pub. Date: Oct. 21, 2004

(65) Prior Publication Data

US 2006/0180065 A1 Aug. 17, 2006

(30) Foreign Application Priority Data

Apr. 11, 2003 (CH) ..... 667/03

(51) Int. Cl.
*D05B 57/26* (2006.01)
*D00B 57/00* (2006.01)

(52) U.S. Cl. ..... 112/180; 112/186

(58) Field of Classification Search ..... 112/181–194, 112/228–234
See application file for complete search history.

(56) References Cited

U.S. PATENT DOCUMENTS

| | | | | |
|---|---|---|---|---|
| 862,033 | A | 7/1907 | Tool | |
| 3,031,989 | A * | 5/1962 | Baumotte et al. | 112/180 |
| 3,882,805 | A * | 5/1975 | Bianchi | 112/180 |
| 4,223,617 | A | 9/1980 | Upmeier et al. | |
| 5,400,730 | A * | 3/1995 | Moll et al. | 112/186 |
| 6,994,040 | B2 * | 2/2006 | Rotter et al. | 112/186 |

FOREIGN PATENT DOCUMENTS

| | | |
|---|---|---|
| GB | 378271 | 8/1932 |

* cited by examiner

*Primary Examiner*—Ismael Izaguirre
(74) *Attorney, Agent, or Firm*—Volpe and Koenig, P

(57) ABSTRACT

A hook (15) of a sewing machine (1) is pivotably mounted on a hook carrier (25). The hook (15) is moved from a working position (X) into a bobbin case withdrawal position by a pivoting movement of the hook carrier (25). The pivoting movement displaces the hook (15) and the bobbin case (17) towards or above the opening which is opened by the flap (13) in the lower arm (13). In this way, the withdrawal of the bobbin case (17) or the bobbin is significantly simplified.

14 Claims, 6 Drawing Sheets

SEWING OR EMBROIDERY MACHINE

BACKGROUND

The subject matter of the invention is a sewing or embroidery machine according to the preamble of claim 1.

The very minimal supply of bobbin thread in comparison with the needle thread, which can be supplied in any amount outside of the sewing machine, forces the operator of a sewing or embroidery machine to remove the bobbin from the hook in the lower arm, flat bed, or base of the sewing machine and to replace it with a full bobbin at short time intervals. For exchanging the bobbin in a sewing machine with a hook rotating or oscillating about a vertical axis, the fabric must be lifted from the needle plate and the bobbin must be detached from the hook with no or with minimal needle contact and later the new bobbin must be reinserted into this hook. Also, for hooks rotating or oscillating about a horizontal axis, quick bobbin exchanges require a certain amount of skill, although the fabric is less of an obstacle for accessing the hook than in the first mentioned example. However, for this reason, there is a worse view of the hook during the bobbin changing process. The tight spatial relationships and the usually very small cross-sectional opening in the lower arm, through which the bobbin case with the bobbin lying therein can be lifted out of the hook housing, also makes the use of bobbins with a larger quantity of thread more difficult.

This disadvantage applies to all sewing machines, both household sewing machines and also industrial sewing machines, for which, due to economical reasons, a faster bobbin change is already a requirement.

Therefore, for industrial or commercial sewing machines, automatic bobbin or hook changer systems have already become known.

From DE-C1 196 53 296, an embroidery machine with a hook changer is known, for which the entire hook including hook shaft, bobbin, and bobbin case, are removed from the hook drive by a handling device and replaced with a new hook with a full bobbin. In a first configuration of this known device, the handling device comprises a revolver carrier, on which the hook with the empty bobbin is placed and is pivoted about an axis after moving away from the hook drive and then the full hook is placed on the hook drive. Here, the revolver of the handling device performs not only a rotational movement, but simultaneously also a shifting movement. Such a device can definitely replace an empty bobbin with a full bobbin within a short time. However, the hook with the empty bobbin must be removed from the handling device. Then the bobbin must be detached from the hook and replaced with a new, full bobbin. Such a device cannot be used in a household sewing machine with a free arm due to reasons of space. In addition, the costs for such a hook changer are disproportionate to the costs of the sewing machine. The use of such a hook changer is thus limited to flat bed, embroidery, or sewing machines, which are used in industrial applications. Use in a free arm household sewing machine is not possible.

Furthermore, from EP-A1 829565, an automatic bobbin changer for a flat bed sewing machine is known, for which the empty bobbin together with the bobbin case is detached from the hook with a handling device that can move on a curved track, is fed to a revolver carrying several bobbin cases with bobbins, and then a bobbin case with a full bobbin is taken from this revolver and brought to the hook. This device also can be used only in commercial machines.

SUMMARY

The object of the present invention is to create a sewing or embroidery machine, which enables the simple exchange of empty bobbins with a full bobbin or a bobbin with differently colored thread without the use of a complicated handling device. Another object of the invention is the ability to arrange the device enabling the simple exchange of the bobbin within a free arm of a household sewing machine. This object is achieved by a sewing or embroidery machine according to the features of claim 1.

The arrangement of the hook with the hook shaft on a pivoting device enables it to pivot the hook from a poorly accessible working position into a bobbin changing position that is optimally accessible from the outside for changing the bobbin. In a preferred embodiment of the invention, the hook itself also always remains in meshed, i.e., positive-fit, contact with its drive during the pivoting movement, so that after the bobbin change, the hook assumes the same exact rotational angle position as before the bobbin change.

Another advantage of the invention is that after manufacturing the sewing machine, the hook can be adjusted relative to the needle with very low expense. Also, readjustment, for example, after a machine inspection, can be performed without a problem. The technical expense for realizing the pivoting movement of the hook is extremely small and is limited essentially to a pivot arm, which can pivot about a fixed or rotating axis in the machine housing essentially without play and which carries the hook.

Through the use of a pivoting hook bearing, the hook can be arranged behind the needle in the sewing direction also for household sewing machines, analogous to industrial sewing machines. This arrangement enables significantly improved stitching quality and stitching safety. In addition, this arrangement can use a significantly larger hook, i.e., a hook, in which a significantly larger bobbin, e.g., with twice the quantity of thread, can be inserted.

The pivoting hook according to the invention further enables the sewing of longer stitches, e.g., for lifting. By slightly pivoting the hook, during the stitching of the needle, the needle thread cannot be hooked and is consequently pulled out again from the fabric by the needle and in this way a stitch is "skipped." The slight deflection of the hook, which is necessary for this measure, enables a previously excessively long stitch to be generated in a simple way, without requiring, for example, the needle shaft to be disengaged from and then re-engaged by the drive.

BRIEF DESCRIPTION OF THE DRAWINGS

The invention is explained in more detail with reference to illustrated embodiments. In the drawings.

DETAILED DESCRIPTION OF THE PREFERRED EMBODIMENTS

Figure 1:
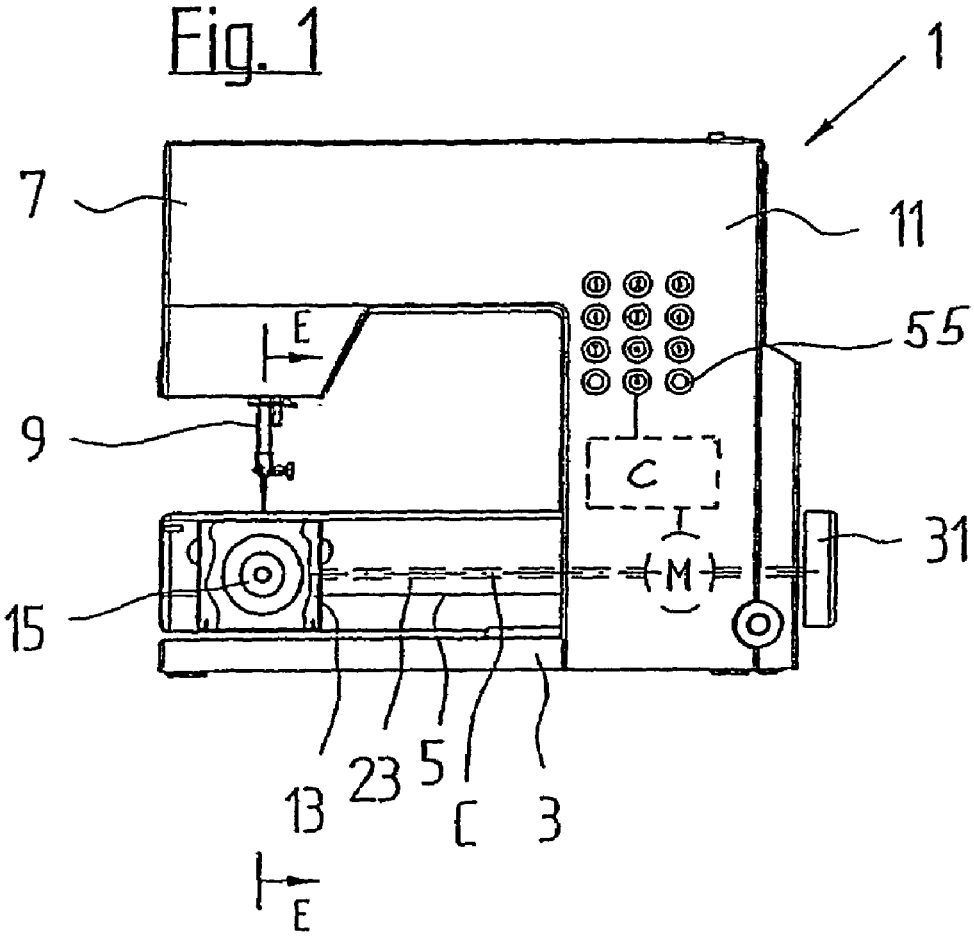
FIG. 1 a view of a household sewing machine with a free arm from the operator side with partially cut away flap on the lower arm, FIG. 2 a vertical section through the lower arm in the sewing plane section E—E with a rotating hook with horizontal rotational axis in working position, transporter left out, FIG. 3 a cross section through the lower arm with the hook in FIG. 2 in bobbin changing position Y, FIG. 4 a cross section through the lower arm with a hook lying behind the needle (in the figure to the left of the needle) with a horizontal rotational axis, FIG. 5 a cross section through the lower arm with the hook in FIG. 4 in bobbin changing position Y, FIG. 6 a vertical section through the lower arm in the sewing plane with a rotating hook with horizontal rotational axis in working position in another configuration of the invention, FIG. 7 a cross section through the lower arm with the hook in FIG. 6 in bobbin changing position Y, FIG. 8 a cross section through the lower arm with a hook lying behind the needle with horizontal rotational axis in another configuration of the invention, FIG. 9 a cross section through the lower arm with the hook in FIG. 8 in bobbin changing position Y, FIG. 10 a vertical section through the lower arm in the sewing plane with a hook rotating in the working position about a vertical axis, FIG. 11 a cross section through the lower arm with the hook in FIG. 10 in bobbin changing position Y, however, the driving bevel gear is arranged behind the hook carrier, FIG. 12 another configuration of the hook bearing according to FIG. 10 in working position, FIG. 13 a cross section through the lower arm with the hook in FIG. 12 in bobbin changing position Y, FIG. 14 another configuration of the invention with a hook rotating about a vertical axis with belt drive, FIG. 15 a cross section through the lower arm with the hook in FIG. 14 in bobbin changing position Y, FIG. 16 a top view of a rotating hook with vertical rotational axis and belt drive, FIG. 17 a horizontal cross section through the lower arm with the hook in FIG. 16 in bobbin changing position Y.

For better illustration of the invention, a household sewing machine 1 is shown in FIG. 1 in a simplified view. This machine comprises a base plate 3, a lower arm or free arm 5 arranged above this base plate at a distance, and a machine top part 7, which is connected to the base plate 3 by means of a vertical column 11, which contains drive elements, such as the motor M and a machine controller C. Furthermore, a needle shaft 9 and a flap 13 (partially cut away), which provides access to a rotating hook 15 from the operator side, are shown on the lower arm 5.

Figure 2:
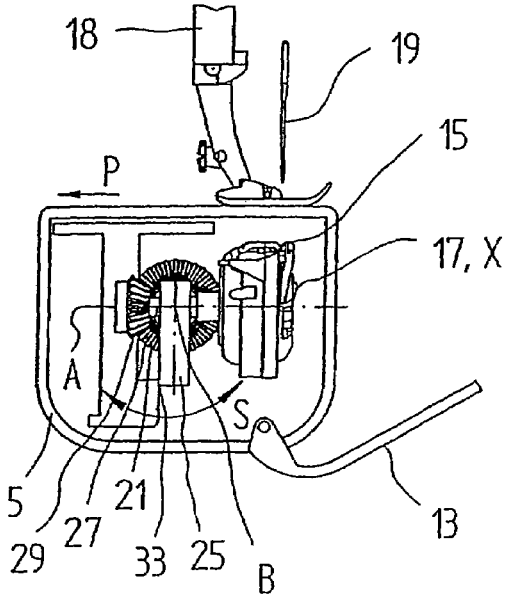

FIG. 2 shows, in the enlarged illustration of a vertical section along line E—E in FIG. 1, how the hook 15 with a bobbin case 17 is inserted, in turn, into a sewing machine 1 according to FIG. 1. Viewed in the sewing direction P, there is a needle 19 in front of the sewing presser bar 18. The flap 13 is open, so that from the operator side, i.e., from the right, the hook 15 supported so that it can rotate about a horizontal axis A and the bobbin case 17 inserted therein are visible and accessible. The bobbin lies in the bobbin case 17 and is not visible in the figures. A driven bevel gear, which is placed on the end of the main shaft 23 of the sewing machine 1 in the lower arm 5, is shown with the reference symbol 21. The main shaft 23 is driven by the drive motor M, which is shown in FIG. 1 schematically by a circle. The main shaft 23 is supported so that it can rotate in the lower arm 5. Alternatively, another type of drive is also possible for the hook 15. For example, it can be a servo motor, which is flange mounted on the back of the hook 15 (not shown). The hook shaft 27 is supported so that it can rotate about the shaft A on a hook carrier 25. A driving bevel gear 29 is located at the end of the hook shaft 27, and meshes with the teeth of the driven bevel gear 21, i.e., the teeth are engaged. The hook carrier 25 can pivot about a pivot axis B preferably running at a right angle to the axis A of the hook shaft 27 in the direction of the arrows S. The pivot axis B coincides in the examples according to FIGS. 2 to 13 with the rotational axis C of the main shaft 23. The suspension and pivot bearing of the hook carrier 25, which can have the shape of a "U", is not shown in detail for reasons of better clarity.

Figure 3:
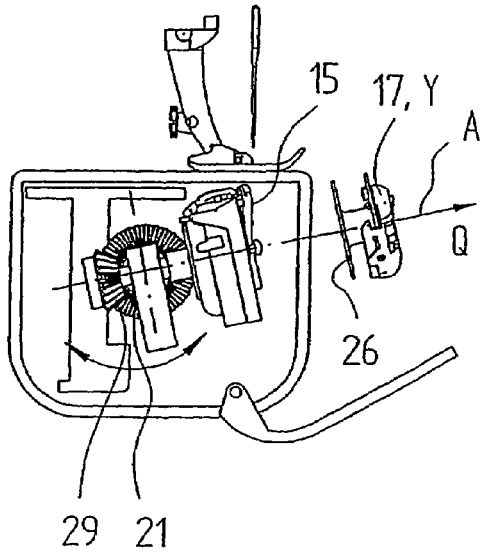

In the first example according to FIGS. 2 and 3, viewed in the sewing direction P, the needle 19 stitches into the fabric (not shown) on the front side of the hook front with the bobbin removal opening. This arrangement, which is typical for household sewing machines, is selected so that the bobbin case 17 can be removed from the operator side out of the lower arm 5, without having to remove the fabric.

FIG. 3 shows the hook 15 after pivoting about the axis B in the counterclockwise sense by approximately 20°. The bobbin case 17 with the bobbin 26 lying therein has already been removed in the direction of the arrow Q from the hook 15. When the hook 15 together with the driving bevel gear 29 rotates, the latter remains in interlocking engagement with the driven bevel gear 21 on the main shaft 23. Thus, it is guaranteed that after the return pivoting of the hook 15 into the working position X (FIG. 2), it again assumes the same rotational position of hook 15 relative to the needle 19 as before the pivoting movement occurred. The pivoting movement of the hook 15 together with its driving elements in the bobbin changing position Y can be realized by reversing the rotational direction of the main shaft 23, e.g., by rotating the hand wheel 31 or the drive motor M controlled by the electronic controller C. To trigger this pivoting movement, no additional technical devices are necessary. In the working position X, the hook 15 or the hook carrier 25 contacts a stop 33. It is pressed against the stop 33 by the moment acting on the driving bevel gear 29. As soon as the hook shaft 23 has turned back in the working direction after the bobbin change, the hook carrier 25 with the hook 15 pivots back into the working position X. A suitable locking device (not shown) can guarantee the position of the hook 15 in the working position X.

Figure 4:
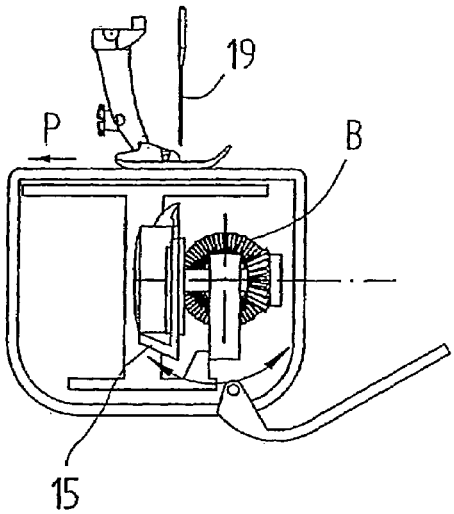
Figure 5:
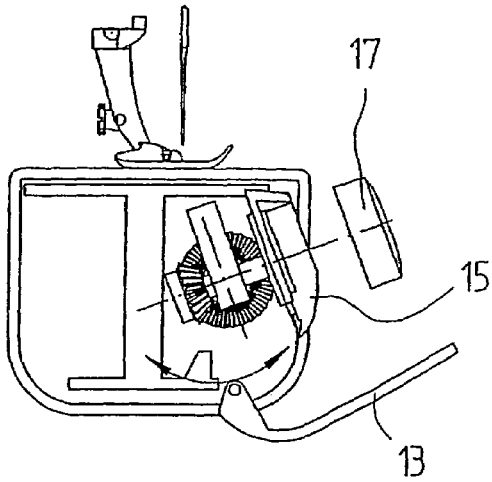

In the second embodiment according to FIGS. 4 and 5, viewed in the sewing direction P, the hook 15 lies behind the needle 19. This arrangement enables, as can also be easily seen from the drawing, on one hand, a better stitching pattern in terms of sewing to be achieved and, on the other hand, in the area behind the needle 19, sufficient space is available to be able to house a larger hook 15, e.g., an industrial sewing machine hook. Thus, a larger bobbin can be used, whose thread quantity is, for example, greater by fifty or a hundred percent relative to the quantity of a bobbin possible in an arrangement according to the first embodiment (FIGS. 2 and 3). This hook arrangement previously forced the sewer to remove the bobbin from the rear side of the sewing machine and also to insert a new, full bobbin without visual contact.

Figure 6:
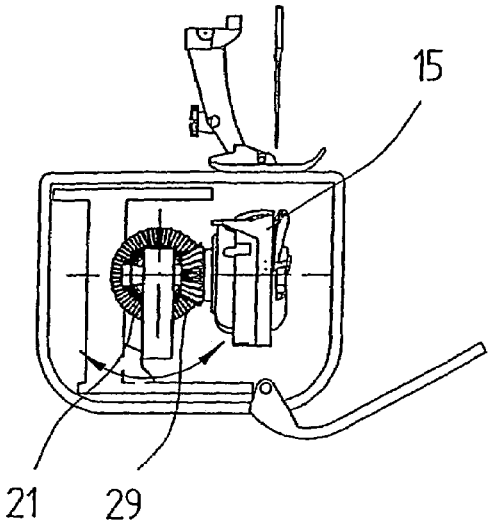
Figure 7:
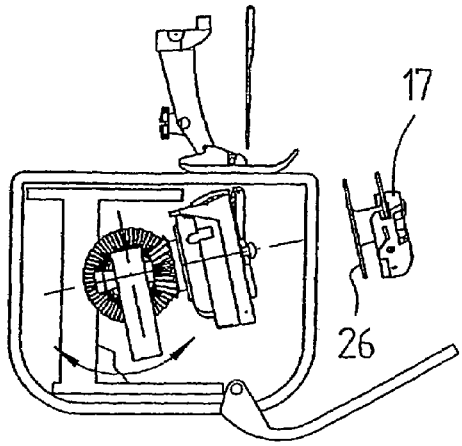

In the third embodiment according to FIGS. 6 and 7, the hook 15 is arranged as in FIG. 2 and 3, but in this configuration, the driving bevel gear 29 is placed into engagement on the operator side of the driven bevel gear 21. As in the first embodiment due to the pivoting, the accessibility is only minimally improved in this embodiment.

Figure 8:
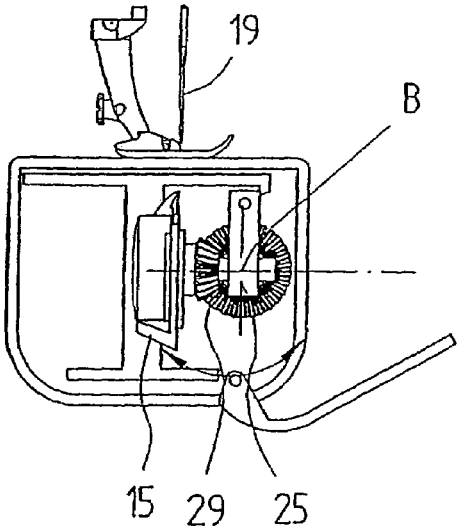
Figure 9:
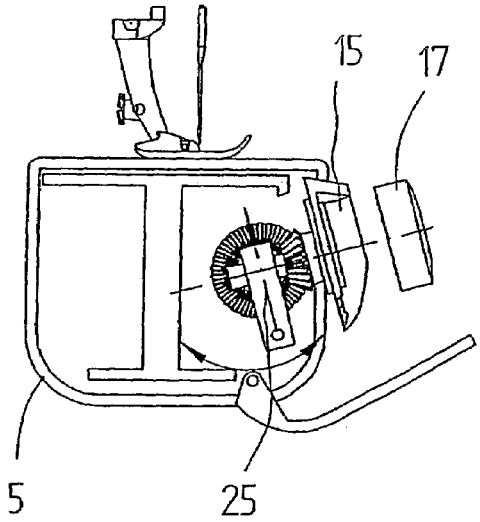

A significant improvement of the accessibility of the hook 15 and thus the bobbin case 17 is given in the fourth embodiment according to FIGS. 8 and 9.

There, the hook 15 is arranged, in turn, behind the needle 19 and the driving bevel gear 29 of the hook shaft 27 lies directly on the rear side of the hook 15. When the hook carrier 25 pivots about the pivot axis B, which coincides in all of the previous cases with the rotational axis C of the main shaft 23 of the sewing machine 1, the hook 15 and the bobbin case 17 lying therein is pivoted out of the cross section of the lower arm 5 and is optimally accessible in the working region of the sewing machine 1.

Figure 10:
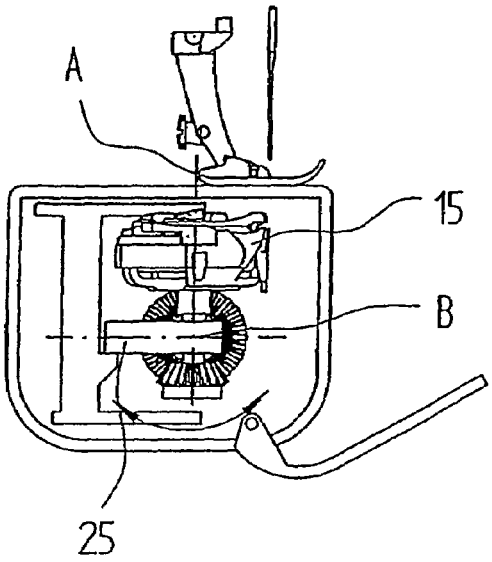
Figure 11:
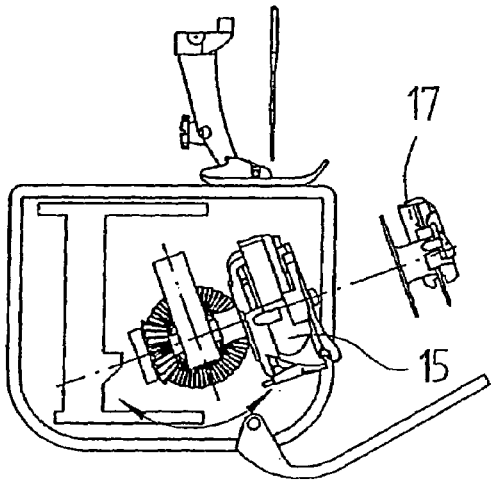

The fifth embodiment according to FIGS. 10 and 11 shows a hook 15, which oscillates or rotates about a vertical hook rotational axis A. In conventional sewing machines 1, a cover, which closes an opening, is inserted into the needle plate above the hook 15, and is removed in order to be able to lift the bobbin out of the hook 15. According to the invention, this cover is no longer needed in the needle plate, because the hook 15 can pivot about the rotational axis B of the hook carrier 25 in the counterclockwise sense by ca. 280° or by ca. 80° in the clockwise sense and then is easily accessible from the front as in the first embodiments.

Therefore, a significant increase in the size of the bobbin is possible just for this type of hook, because when removing the bobbin, the transporter, needle plate, or presser bar no longer represent an obstacle.

Figure 12:
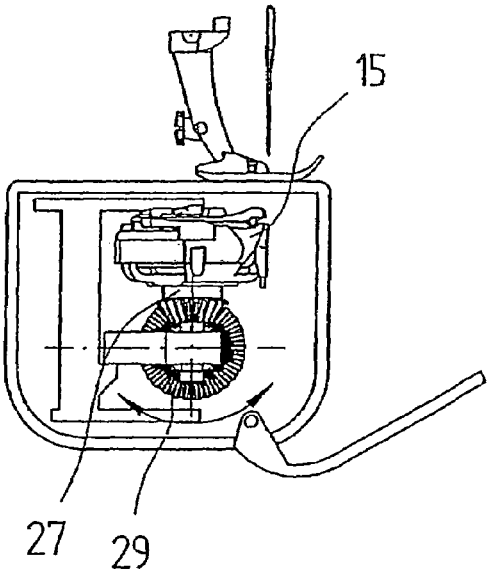
Figure 13:
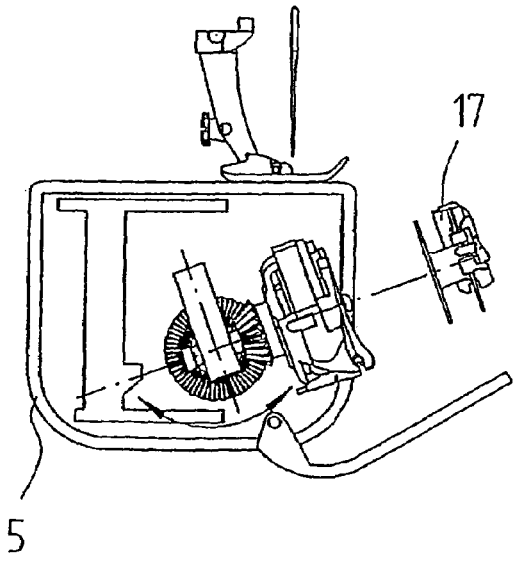

Even better accessibility of the hook 15 rotating about a vertical axis A is visible in the sixth embodiment according to FIGS. 12 and 13. Through the displacement of the driving bevel gear 29 on the hook shaft 27 directly on the rear side of the hook 15, the hook 15 is pivoted outwards partially out of the lower arm 5 after the pivoting by ca. 280° or by ca. 80°. Thus, the bobbin case 17 can be gripped without having to reach into the interior of the lower arm 5. Alternatively, a hook 15 could also be used, for which the bobbin is not in a bobbin case 17 and which consequently can be lifted directly out of the hook 15.

Figure 14:
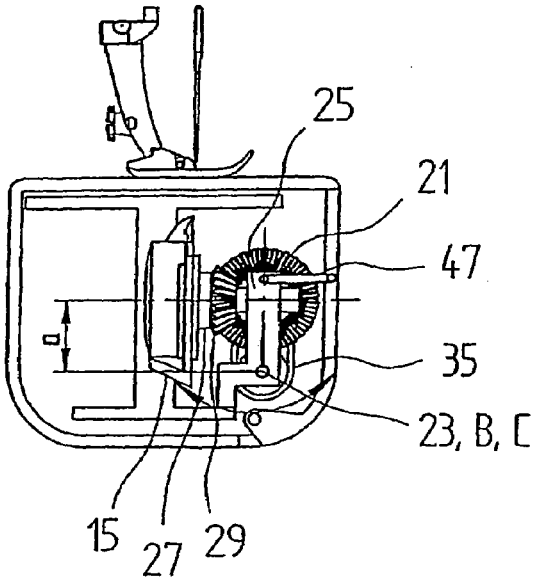
Figure 15:
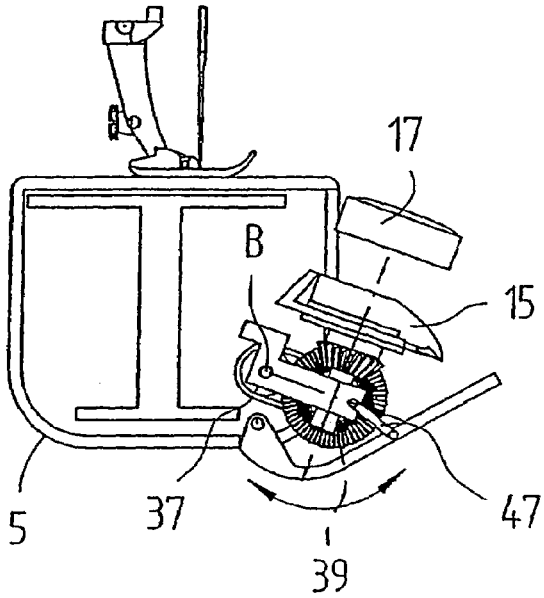

In the seventh configuration of the invention according to FIGS. 14 and 15, the hook 15 or the driving bevel gear 29 on the hook shaft 27 is no longer driven directly by means of a driven bevel gear 21 on the main shaft 23, but instead the driven bevel gear 21 is offset parallel to the main shaft 23 and is driven by a toothed belt 35. Here, the hook carrier 25 carries not only the hook 15 with the driving bevel gear 29, but also carries the driven bevel gear 21. A driven pinion 37, which transfers the driving torque to a driving pinion 39 via the toothed belt 35, sits on the main shaft 23. The toothed belt 35 could also be replaced by an intermediate gear. The driving pinion 39 is locked in rotation with the driven bevel gear 21, which—like the hook shaft 27 and the driving bevel gear 29—is supported on the hook carrier 25. The pivot axis B of the hook carrier 25 lies, in turn, in the rotational axis C of the main shaft 23. Because the rotational axis C of the driven bevel gear 21 is arranged at a distance 'a' from the rotational axis B, the hook 15 now pivots on a significantly larger arc and lies outside of the lower arm 5 after a pivoting movement of ca. 260° or by ca. 100° and is consequently optimally accessible.

Figure 16:
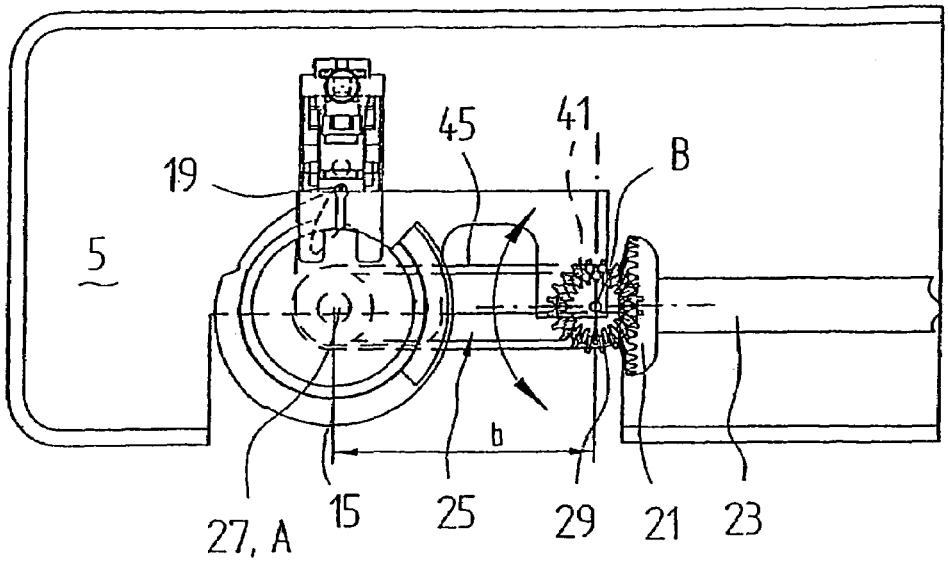
Figure 17:
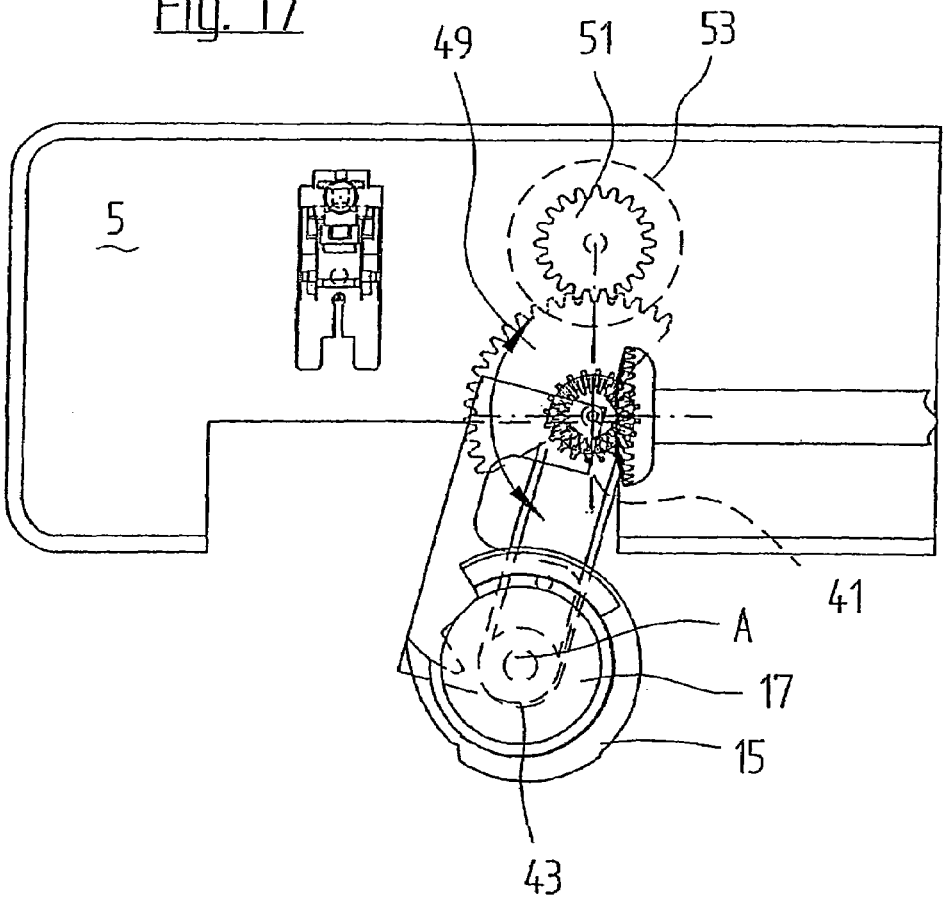

In the eighth embodiment according to FIGS. 16 and 17, which show a horizontal section through the free arm 5, a hook 15 with a vertical hook rotational axis A, in turn, is provided. The pivot axis B of the hook carrier 25 does not coincide in this example with the rotational axis C of the main shaft 23, but instead it lies parallel to the axis A of the hook 15. The driven bevel gear 21 is placed, in turn, on the main shaft 23 and it engages with the driving bevel gear 29 for the hook 15. However, this is not arranged on the hook shaft 27, but instead on the hook carrier 25 and also at a distance b to the latter. Furthermore, a coaxial first toothed pinion 41 is locked in rotation with a driving bevel gear 29. A toothed belt 45 transfers the driving moment of the driving shaft 23 from the first toothed pinion 41 to a second toothed pinion 43, which sits rotationally locked on the hook shaft 27.

The distance 'b' between the pivot axis B of the hook carrier 25 to the rotational axis A of the hook 15 has the effect that when pivoted, the hook 15 here rotating about a vertical axis A is moved completely out of the lower arm 5, thus enabling optimal accessibility to the bobbin case 17 or to the bobbin.

Like in the first embodiment, for the other embodiments, the pivoting of the hook 15 can also be caused by a reverse in the rotational direction of the main shaft 23. The return pivoting is realized by a second reversal of the rotational direction, i.e., into the normal rotational direction.

Obviously, it is also conceivable that the pivoting is caused, for example, by a mechanical connection between the flap 13 on the lower arm 5 and the hook carrier 15. In FIGS. 14 and 15, one possible embodiment for automatic pivoting of the hook 15 when the flap 13 opens is shown. A one-arm lever 47 connecting the flap 13 to the hook carrier 25 pivots the hook 15 simultaneously outwards from the lower arm when the flap 13 opens and back again when the flap 13 closes.

It is also possible to embody the pivoting movement of the hook carrier 25 by an electric drive. In FIGS. 16 and 17, such a drive is shown. An electric motor 53, on whose driven shaft a toothed pinion 51 sits, is in an interlocking connection with a toothed segment 49, which is connected rigidly to the hook carrier 25. Through a rotational movement of ca. 80°, the pivoting of the hook 15 can be performed by the electric motor 53. The control of the electric motor 53 can be realized by means of the machine controller C or a button 55 provided for this reason on the control panel or by a switch (not visible) connected to the flap (13).

In the examples, bevel gear gears were described. Other suitable gears could also be used. In addition, in the figures, the working position X and the bobbin changing position Y are each shown. However, it is also possible to remove or to eject the bobbin case 17 in an intermediate position and to insert the full bobbin 26 in a different angular position.

In all of the embodiments, through suitable sensors, it is guaranteed that the drive of the needle is interrupted at the beginning of the pivoting movement of the hook carrier 25.

In another, not shown embodiment of the invention, the hook, on whose rear side a toothed pinion is attached, is driven directly by a toothed belt, which is connected to the drive. When pivoting, only the hook with the driving pinion attached thereto is pivoted and the driven pinion on the drive of the machine maintains its position on the inside. The relative movement between the driven pinion for the driving belt and the driving pinion is absorbed by twisting of the toothed belt (no figure).

The invention claimed is:

1. Sewing or embroidery machine comprising a hook (15), which oscillates or rotates on a hook rotational axis (A), which can be driven by a drive (M) of the sewing machine (1) and which can be pivoted about a pivot axis (B) from a working position (X) into at least one bobbin changing position (Y), which is at a distance from the working position (X) and which is easily accessible from an outside of the machine, the rotational axis (A) of the hook (15) and a rotational axis of a driving gear (21) intersect at a point or at least cross at a point both in the working position (X) and also in the at least one bobbin changing position (Y), wherein a drive connection (29) of a hook shaft (27) located between the hook (15) and the drive (M) is maintained during pivoting movement of the hook (15) from the working position (X) into the at least one bobbin changing position (Y).

2. Sewing or embroidery machine according to claim 1, wherein the pivot axis (B) coincides with a rotational axis (C) of a main shaft (23) of the sewing or embroidery machine.

3. Sewing or embroidery machine according to claim 1, wherein the rotational axis (A) of the hook (15) intersects with the pivot axis (B) in the working position (X).

4. Sewing or embroidery machine according to claim 1, wherein the pivot axis (B) lies parallel to the rotational axis (A) of the hook (15).

5. Sewing or embroidery machine according to claim 1, wherein the hook (15) is supported so that it can rotate on a hook carrier (25) and can pivot with the hook carrier (25) on the pivot axis (B).

6. Sewing or embroidery machine according to claim 5, wherein a driving bevel gear (29) is arranged on a hook shaft (27) of the hook directly on a hook rear side in front of the pivot axis (B) or behind the pivot axis (B) and behind the hook carrier (25).

7. Sewing or embroidery machine according to claim 6, wherein a driven pinion (37) is located on a main shaft (23) of the sewing machine (1) and is in active connection through a toothed belt (35) or through an intermediate gear with a driving pinion (39), which is locked in rotation on a driven bevel gear (21), and the driving pinion (39) is supported on the hook carrier (25).

8. Sewing or embroidery machine according to claim 6, wherein the hook carrier (25) can pivot about the pivot axis (B) that extends parallel to the hook shaft (27) and a driving bevel gear (29) interlocking with the driven bevel gear (21) located on the main shaft (23) and a first toothed pinion (41) is located on the pivot axis (B), and a toothed belt (45), which loops around a second toothed pinion (43) attached to a rear side of the hook (15), rotates on the first toothed pinion (41) or an intermediate gear is inserted between the toothed pinion (41) and the second toothed pinion (43).

9. Sewing or embroidery machine according to claim 1, wherein a bobbin ejection position is formed between the working position (X) and the bobbin changing position (Y).

10. Sewing or embroidery machine according to claim 5, wherein for pivoting the hook carrier (25), a lever (47) connects the hook carrier (25) to a flap (13) on the lower arm (5), or an electric motor (53) is provided in driving connection with the hook carrier (25) or the main shaft (23).

11. Sewing or embroidery machine according to claim 5, wherein the rotational direction of the drive motor (M) of the sewing machine (1) is reversible for pivoting the hook carrier (25).

12. Sewing or embroidery machine comprising a hook (15), which oscillates or rotates on a hook rotational axis (A), which can be driven by a drive (M) of the sewing machine (1) and which can be pivoted about a pivot axis (B) from a working position (X) into at least one bobbin changing position (Y), which is at a distance from the working position (X) and which is easily accessible from an outside of the machine, the rotational axis (A) of the hook (15) and a rotational axis of a driving gear (21) intersect at a point or at least cross at a point both in the working position (X) and also in the at least one bobbin changing position (Y), the hook (15) is supported so that it can rotate on a hook carrier (25) and can pivot with the hook carrier (25) on the pivot axis (B), a driving bevel gear (29) is arranged on a hook shaft (27) of the hook directly on a hook rear side in front of the pivot axis (B) or behind the pivot axis (B) and behind the hook carrier (25), and a driven pinion (37) is located on a main shaft (23) of the sewing machine (1) and is in active connection through a toothed belt (35) or through an intermediate gear with a driving pinion (39), which is locked in rotation on a driven bevel gear (21), and the driving pinion (39) is supported on the hook carrier (25).

13. Sewing or embroidery machine comprising a hook (15), which oscillates or rotates on a hook rotational axis (A), which can be driven by a drive (M) of the sewing machine (1) and which can be pivoted about a pivot axis (B) from a working position (X) into at least one bobbin changing position (Y), which is at a distance from the working position (X) and which is easily accessible from an outside of the machine, the rotational axis (A) of the hook (15) and a rotational axis of a driving gear (21) intersect at a point or at least cross at a point both in the working position (X) and also in the at least one bobbin changing position (Y), the hook (15) is supported so that it can rotate on a hook carrier (25) and can pivot with the hook carrier (25) on the pivot axis (B), and for pivoting the hook carrier (25), a lever (47) connects the hook carrier (25) to a flap (13) on the lower arm (5), or an electric motor (53) is provided in driving connection with the hook carrier (25) or the main shaft (23).

14. Sewing or embroidery machine comprising a hook (15), which oscillates or rotates on a hook rotational axis (A), which can be driven by a drive (M) of the sewing machine (1) and which can be pivoted about a pivot axis (B) from a working position (X) into at least one bobbin changing position (Y), which is at a distance from the working position (X) and which is easily accessible from an outside of the machine, the rotational axis (A) of the hook (15) and a rotational axis of a driving gear (21) intersect at a point or at least cross at a point both in the working position (X) and also in the at least one bobbin changing position (Y), the hook (15) is supported so that it can rotate on a hook carrier (25) and can pivot with the hook carrier (25) on the pivot axis (B), and the rotational direction of the drive motor (M) of the sewing machine (1) is reversible for pivoting the hook carrier (25).

* * * * *